United States Patent [19]

Hoffmeister

[11] Patent Number: 4,676,397

[45] Date of Patent: Jun. 30, 1987

[54] E-Z-T GOLF BALL DISPENSER

[76] Inventor: Fred L. Hoffmeister, R.R. 1, Box 294, Webb City, Mo. 64870

[21] Appl. No.: 833,542

[22] Filed: Feb. 27, 1986

[51] Int. Cl.[4] ..... A63B 57/00; B65G 59/06

[52] U.S. Cl. ..... 221/105; 221/121; 221/293; 221/194; 221/199; 294/19.2; 273/201; 273/32 D

[58] Field of Search ..... 221/105, 121, 122, 298, 221/299, 292, 293, 194, 196, 185; 294/19.2; 273/32 D, 32 A, 201

[56] References Cited

U.S. PATENT DOCUMENTS

| | | | |
|---|---|---|---|
| 1,418,093 | 5/1922 | Parmater | 221/298 |
| 2,171,299 | 8/1939 | Beckett | 221/298 |
| 2,216,853 | 10/1940 | Middleton | 221/298 |
| 2,278,013 | 3/1942 | Nicholson | 221/105 |
| 2,609,198 | 9/1952 | Armstrong | 294/19.2 |
| 3,127,177 | 3/1964 | Berkoe | 221/194 |
| 3,186,593 | 6/1965 | Miote | 273/32 D |
| 3,281,013 | 10/1966 | Motard | 294/19.2 |
| 3,434,753 | 3/1969 | De Croes | 294/19.2 |
| 3,599,983 | 8/1971 | Melton | 221/298 |
| 4,575,092 | 3/1986 | Watson | 273/32 D |

*Primary Examiner*—H. Grant Skaggs

*Attorney, Agent, or Firm*—Kerkam, Stowell, Kondracki & Clarke

[57] ABSTRACT

E-Z-T Golf Ball Dispenser is a device used by an individual on a practice tee or similar surface for the convenient placement of golf balls on a practice tee and the retrieval or pick-up of balls on and around a practice tee. The device allows for ease in carrying and is free-standing. The device allows for the storage of multiple golf balls due to the utilization of three (3) metal tubes in which golf balls are placed. By pressing a lever, a golf ball is released from storage to the lower horizontal portion of the device which is rounded and cut out in front to allow for the placement of the ball on a tee from above and the removal of the device from the tee by lowering the device thereby placing the ball on the tee and sliding the device away from the tee. Conversely, this device can also be used for the pick up of a single ball and placement on a tee thereby reducing the necessity of a golfer to bend over and pick up a ball.

4 Claims, 6 Drawing Figures

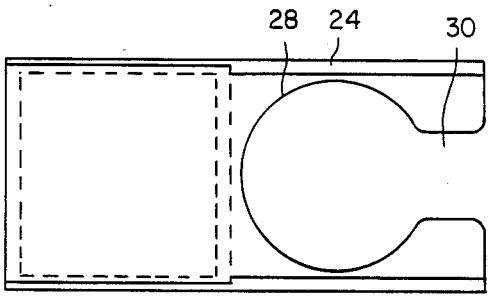
FIG. 2
FIG. 3
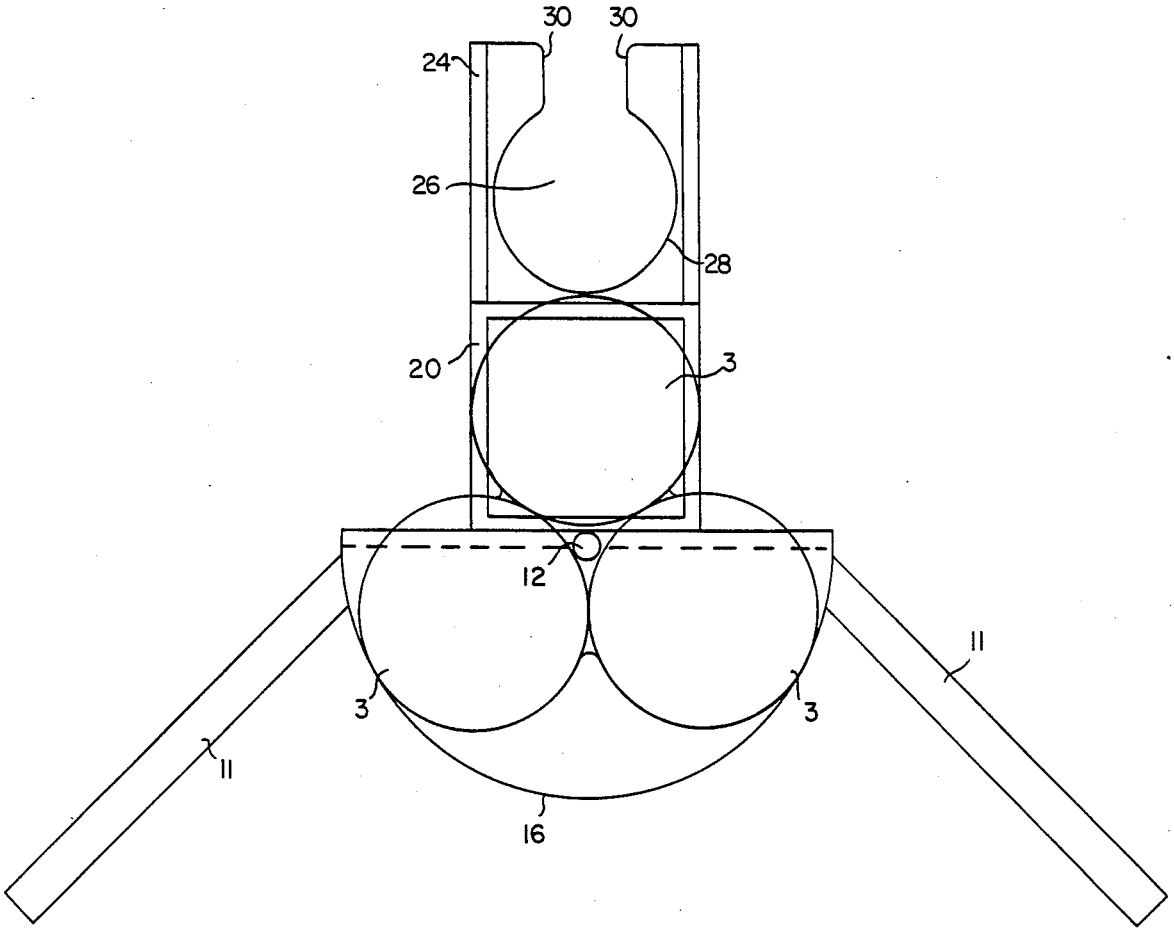

E-Z-T GOLF BALL DISPENSER

SUMMARY OF THE INVENTION

The object of the E-Z-T Golf Ball Dispenser is to allow a golfer the convenience of standing at a practice tee and hitting multiple golf balls from a practice tee without the necessity of bending over each time he wishes to place a ball on the tee.

The E-Z-T Golf Ball Dispenser is a relatively simple device which allows for the placement of a golf ball on a tee by a foot activated release from which a single ball passes from one of three storage tubes to the dispensing mechanism.

The three storage tubes allow for the storage of golf balls and rotate around a steel shaft secured to the lower dispensing mechanism. When one tube is emptied of golf balls, the golfer merely rotates the tube and upon emptying the second tube, repeats the process once again for the third tube.

The balls are released from the storage tubes by activating the foot release which simultaneously interrupts the flow of balls from the upper storage tube compartment and lowers a single ball to a base plate so that the ball can be placed upon a golf tee and the E-Z-T Golf Ball Dispenser is then set aside from the tee area without disturbing the ball.

If for some reason the ball should fall off the tee or if the golfer would like to place a ball on the tee from the ground rather than from the dispenser, the base plate is designed in a tapered, serrated fashion as to allow the easy scooping up of the ball for placement on the tee. The pick up of a golf ball on the surface is facilitated by the design of the base plate wherein the face of the base plate and the inner portion thereof resembles a knife, thereby allowing the base plate to present less of an obstruction in the scooping up of the ball and allowing the golfer to more easily place the base plate under the ball without bending over to pick up the ball by hand.

This combination of the rotating tubes, the dispensing device and trigger mechanism, and the scoop-like tapered jaws when applied to the controlling of a golf ball are original, and unique, and never before applied in combination to a mechanism allowing for the golfer to tee up a golf ball without the necessity of bending over.

BRIEF DESCRIPTION OF THE DRAWINGS

The invention will be more easily understood from the following detailed description taken in conjunction with the accompanying drawings wherein like reference characters represent like parts throughout the several views, wherein:

FIG. 2 shows a stop section view of the base plate taken along section line 2—2 of FIG. 1.

FIG. 3 shows a top sectional view of the device taken along section line 3—3 of FIG. 1.

REFERENCE TO THE DRAWINGS

Figure 1:
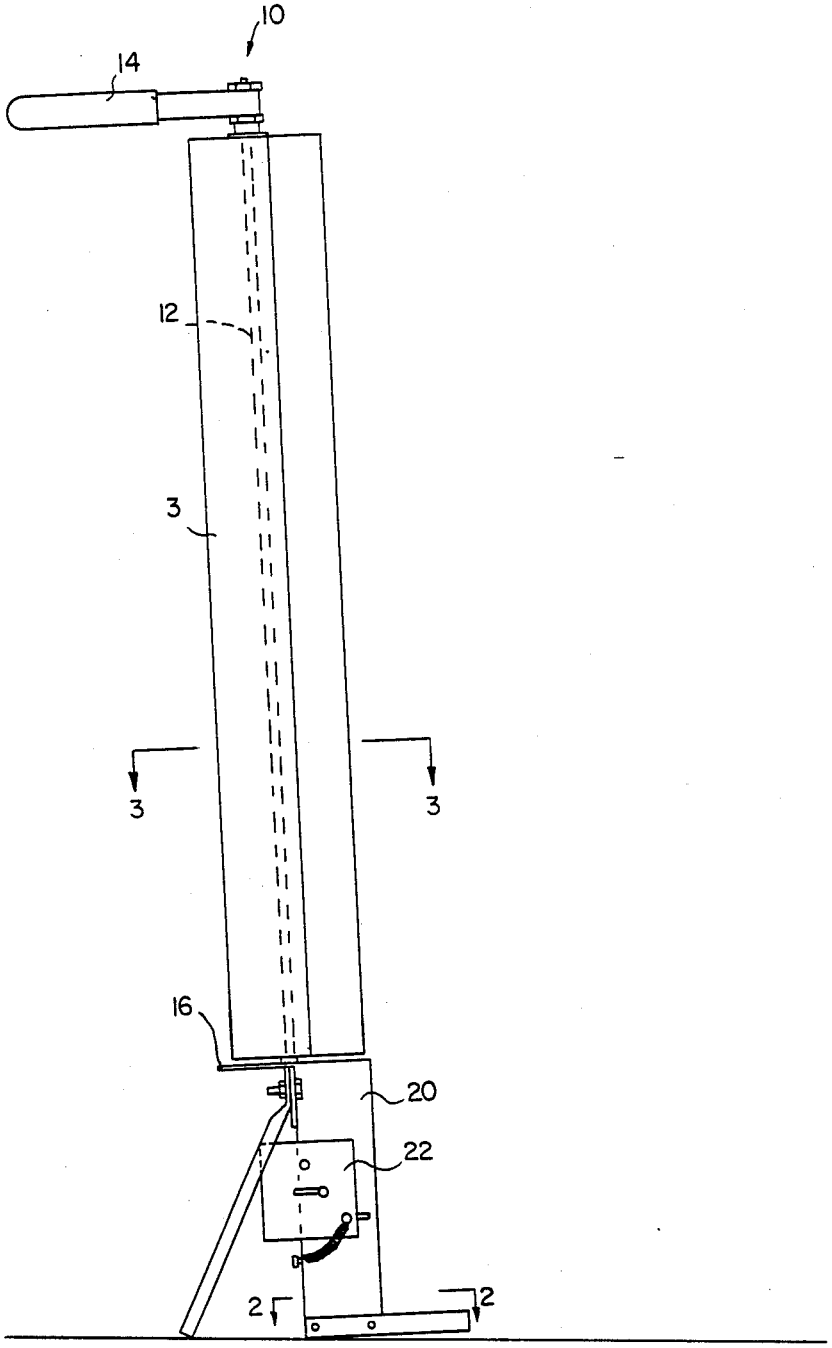
FIG. 1 shows a side elevation view of a golf ball dispensing and teeing device according to a preferred embodiment of the present invention.

Attached hereto and incorporated herein by reference are six (6) drawings depicted in FIGS. 1–6 inclusive. FIG. 1 depicts a side view of the E-Z-T Golf Ball Dispenser including the handle connected to an internal steel shaft which runs to the base tube and foot release mechanism. Also depicted in FIG. 1 is one leg of the bypod device which allows the device to stand free.

FIG. 2 depicts the base plate plan comprising of two basic elements: the first element is a square device which is the lower portion of the base tube. This is the lower most element of the device and upon release of the ball from the base tube, the ball first falls on to this portion of the base plate. To the right of this portion of the base plate as depicted in FIG. 2 is a portion of the base plate similar in shape to a keyhole. This keyhole portion of the base plate is rounded wherein the ball can "sit" awaiting for placement on a tee and then when placement is achieved, the base plate and device can be removed from the tee through the keyhole slot opening. FIG. 3 is another downward view of the base plate plan showing the bypods which allow for the freestanding of the device and, in addition, shows the placement of the three metal tubes centered around a metal shaft. One tube is immediately above the base tube, the three tubes being round in shape, whereas, the base tube is square in shape.

Figure 4:
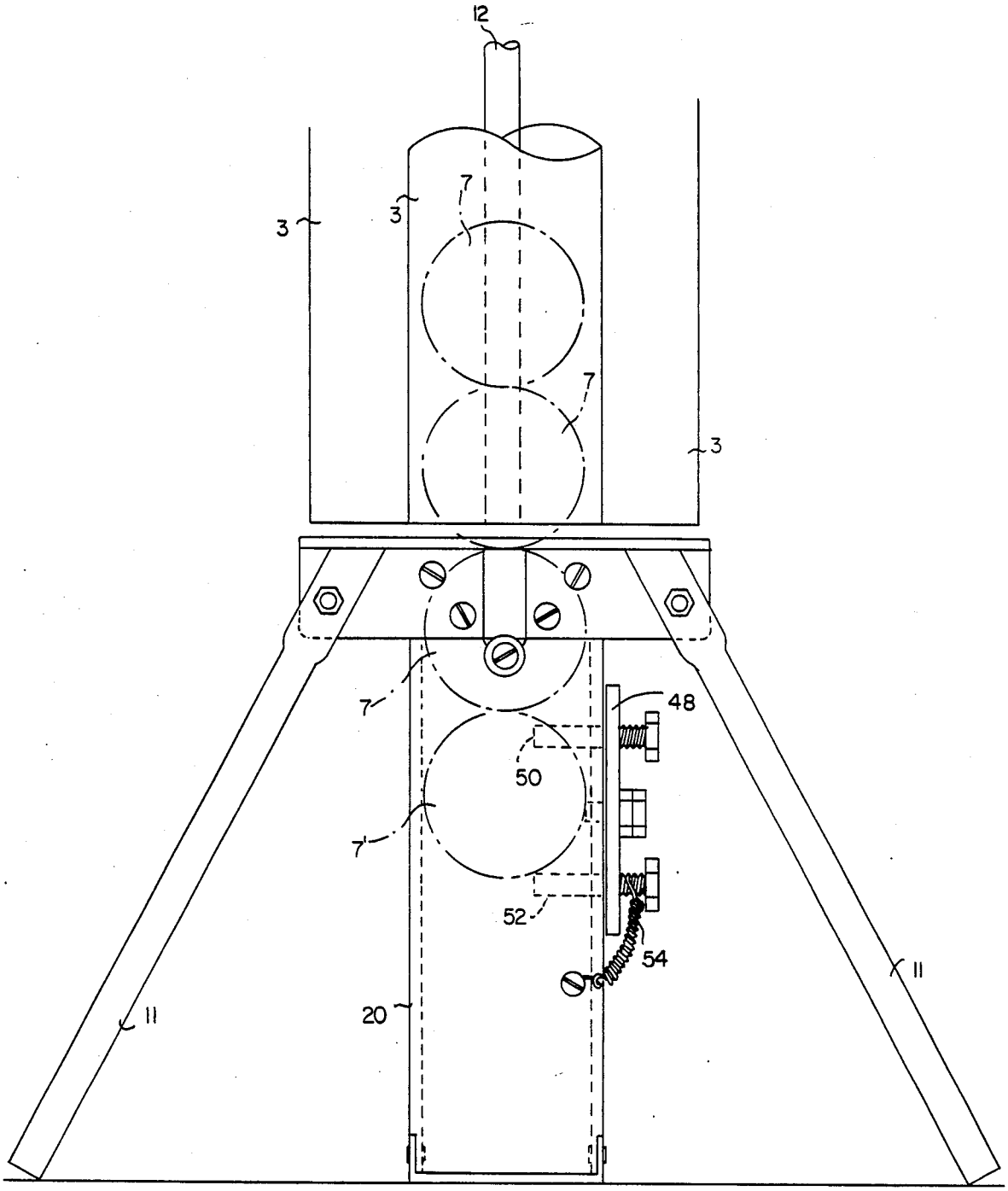
FIG. 4 shows a rear elevation view of a lower part of the device in the present invention.

FIG. 4 depicts the base tube and foot release in detail, again showing or depicting balls flowing from a single round metal tube into the lower square base tube mechanism. FIG. 4 also depicts the foot release or trigger mechanism consisting of two bolts protruding into the square base tube, the upper bolt preventing multiple balls from flowing onto the base plate while at the same time the lower bolt allows a single ball to fall onto the base plate preliminary to tee placement. FIG. 4 also depicts a spring which provides for a return of the mechanism and creates tension on the foot release. FIG. 4 also depicts the two legs of the bypod which combined with the base tube allow the device to be freestanding. FIG. 4 is a view from the back elevation of the E-Z-T Golf Ball Dispenser.

Figure 5:
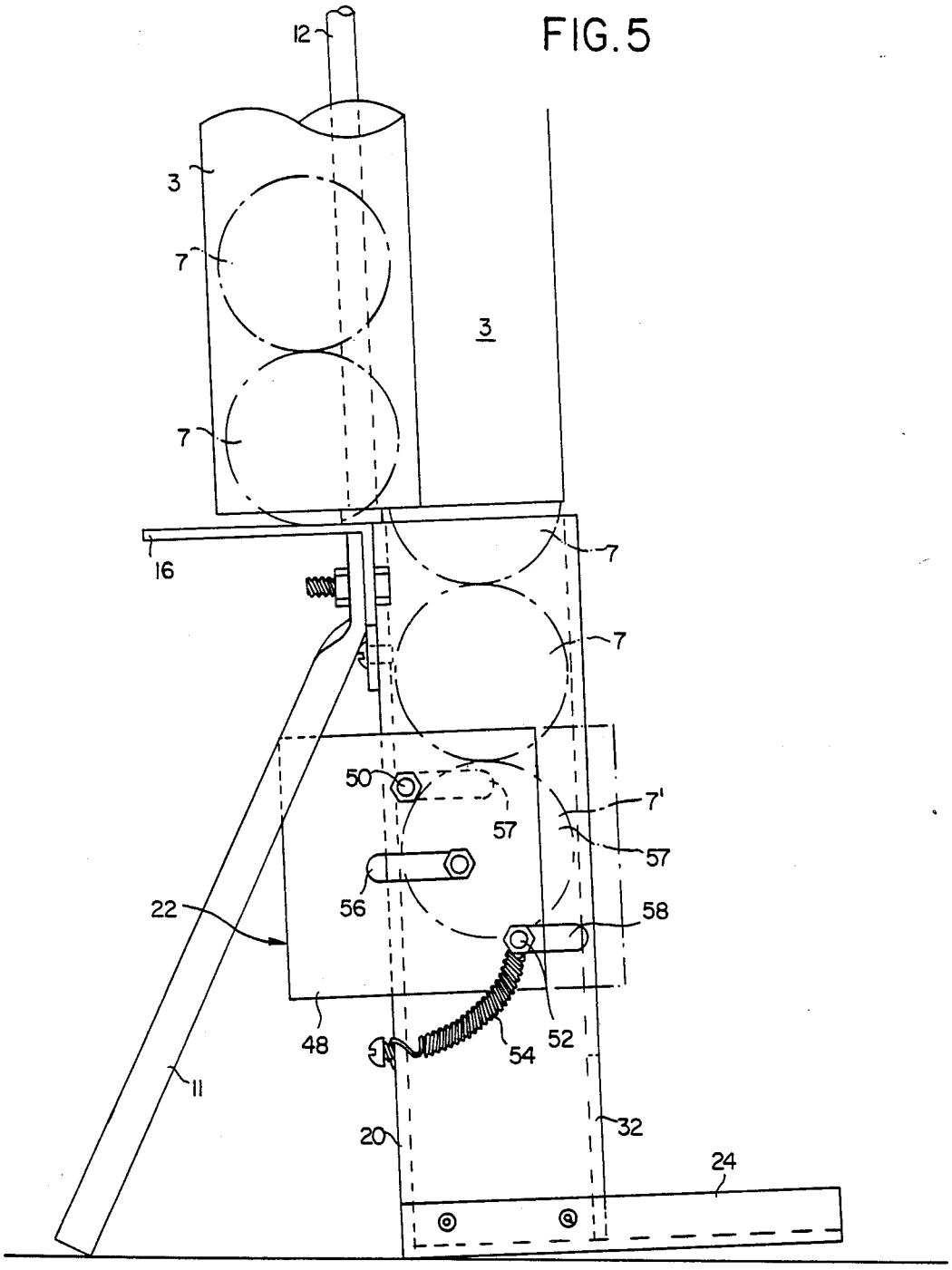
FIG. 5 shows a side elevation view of a lower portion of the dispensing device showing details of the dispenser mechanism.

FIG. 5 depicts one of the three rotating metal tubes not immediately above the square base tube. FIG. 5 also depicts through a side elevation view the actual steel foot release or trigger mechanism which the golfer would press with his foot to allow a ball to fall to the lower portion of the base plate. The spring device is also featured in this drawing as in FIG. 4. Also depicted is one of the two tube supports which create a bypod. Also depicted in FIG. 5 through side elevation is the base plate which protrudes from the lower portion of the base tube.

Figure 6:
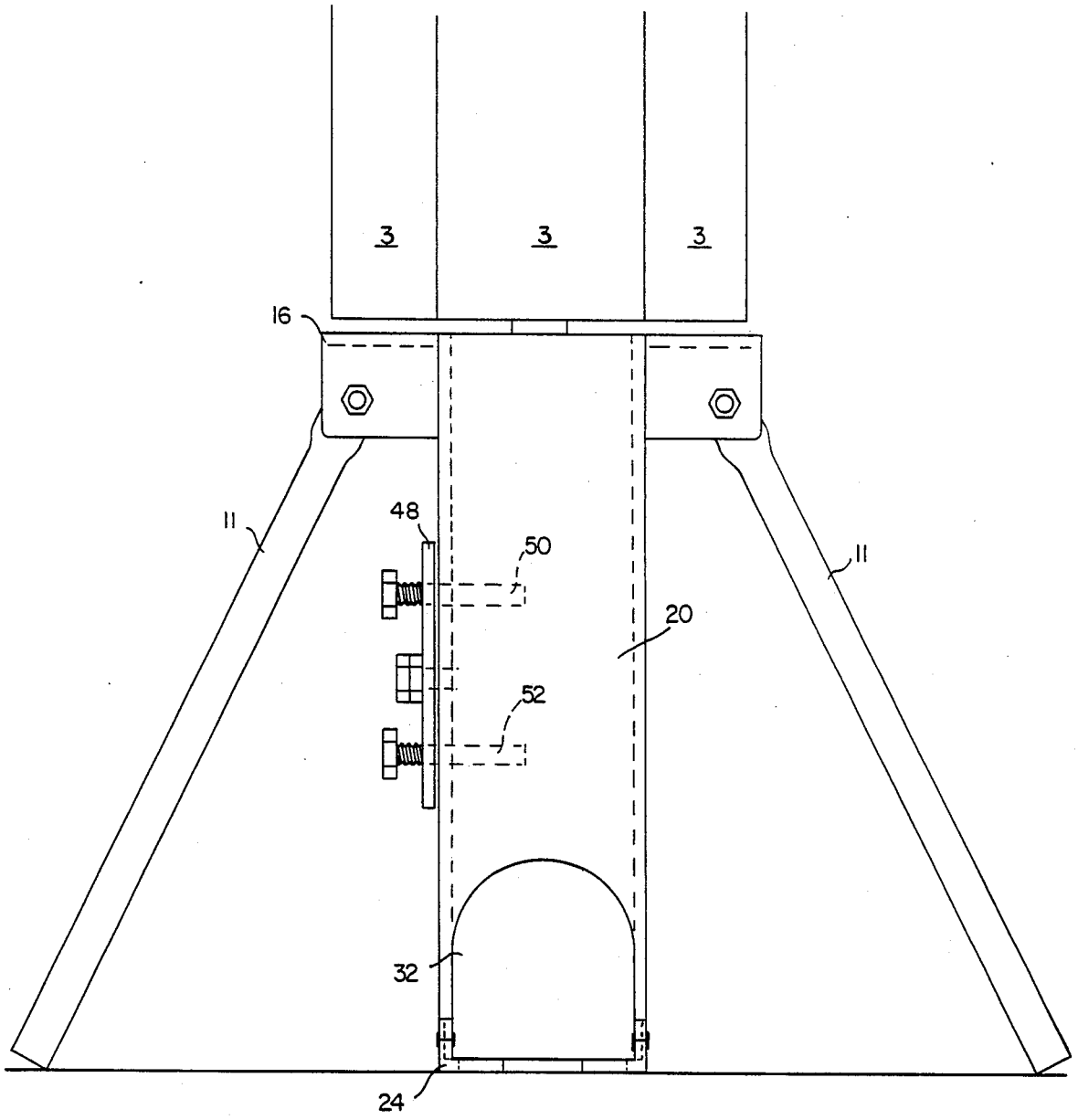
FIG. 6 shows a partial front elevation of th device according to the present invention showing the opening in a lower part of one of the walls of the base tube.

FIG. 6 depicts the base tube from a front elevation. The arched "doorway" at the lower portion of the base tube allows for the ball to roll from the base tube in an outward fashion onto the outer portion of the base plate. Also visible is a front elevation of the foot release along with the two legs of the bypod.

DETAILED DESCRIPTION OF THE INVENTION

Referring initially to FIG. 1, the E-Z-T Golf Ball Dispenser according to a preferred embodiment of the present invention and referred to generally by numeral 10, allows for the storage of golf balls 7 (see FIG. 4) in three cylindrical tubes 03. These three metal tubes will vary in length depending upon the desired storage capacity, and each tube will be two (2) inches in diameter and welded together around a one-quarter (¼) inch in diameter steel shaft 12.

To the uppermost portion of this shaft 12 will be a metal handle 14 secured to the uppermost portion of the steel shaft with nuts and washers as required.

FIG. 1 depicts the side elevation of the E-Z-T Golf Ball Dispenser 10 showing one of three tubes 3 immediately above the base tube 20 and foot release mechanism 22. FIGS. 1 and 2 also show ball-retaining flange 16 which extends underneath two of the tubes 3 which are not at the time located over the base tube 20, to prevent golf balls stored in these tubes from dropping out.

FIGS. 2 and 3 depict the two (2) inch by one-eighth (⅛) inch steel base tube 20 and from which protrudes a steel base plate 24.

The steel base plate 24 is set forth in detail and is four and one-quarter (4¼) inches in length the outermost protrusion best described as a keyhole device 26, a rounded portion 28 thereof having a radius of three-sixteenths (3/16) of an inch. This keyhole is achieved by cutting the metal in the base plate to achieve such a radius and then further forming a slot opening 30 by extending a path to the outermost portion of the base plate 24 from the rounded cut thereof to allow for removal of the E-Z-T Golf Ball Dispenser 10 once the ball has been placed on a rubber tee (not shown).

The base tube 20 and foot release 24 is detailed in FIG. 4 depicting a golf ball 7 in one of the three cylindrical tubes 03, this tube 3 being immediately above the base tube 20. Golf balls 7 are separated from the lowermost golf ball 7' by a first of two cylindrical rods or bolts 50, size three-sixteenths (3/16) of an inch by one and one-quarter (1¼) inch. Immediately beneath the three pictured golf balls 7 is a single golf ball 7' resting on a second, or lower of two three-sixteenth (3/16) inch by one and one-quarter (1¼) inch bolts 52. These bolts 50, 52 are further depicted in FIG. 6 running through the foot release 22. Simple drilling will facilitate the placement of these bolts 50, 52 through the foot release 22.

Depicted in FIGS. 4 and 5 is a biasing means 54 shown as a three-sixteenths (3/16) inch spring which will provide the necessary tension against which the golfer must overcome by pressing his foot in a horizontal fashion against the portion of foot release plate 48 projecting away from the base tube 22. Foot release plate 48 is two and one-half (2½) inches by two and one-half (2½) inches by one-eighth (⅛) inch steel composition. Again, this foot release device 22 would be cut from steel and drilled in such a fashion to allow the placement of the two three (3) by sixteen (16) inch by one and one-quarter (1¼) inch bolts 50, 52 which provide for the simultaneous holding and release of a golf ball when the foot release device is moved. A capsule shaped notch 56 is cut in the immediate center of the steel foot release plate 48 and the notch 56 has a dimension of one-quarter (¼) inch by one (1) inch. Further depicted in FIG. 5 are two similar capsule-like notches 57, 58 cut in an adjacent wall of base tube 20 which allow the steel side plate 48 to move in a horizontal fashion with the two bolts 50, 52 with these notches 57, 58 having a dimension of one-quarter (¼) inch by seven-eighths (⅞) inch each. Also depicted in FIG. 5, is the three (3) by sixteen (16) inch spring 54 which is secured at one end to the lower three-sixteenths (3/16) inch by one and one-quarter (1¼) inch rod 52 and is secured at its other end to the back of the base tube 20 immediately below the steel foot release 22.

A ball 7 is lowered to the lower portion of the base tube 20 onto the base plate 24 by a golfer pressing his foot in a horizontal fashion against the steel foot release 22. By doing so, the lower bolt 52 is moved forward in the slot 58 as depicted in FIG. 5 and allows for a ball to fall in a downward fashion by gravity. Simultaneously with the movement of the lower bolt 52, the upper bolt 50 moves forward through the upper slot 57 as depicted in FIG. 5 and prevents multiple balls from falling in a downward fashion, thereby allowing only one ball to actually fall to the base plate 24 for ultimate tee placement.

The golfer then releases his foot from the steel foot release 22 and the spring 54 through the tension in the spring 54 allows for the return of the foot release 22 along the path of the three slots 56, 57, 58, thereby allowing the ball that was previously prevented from falling by upper bolt 50, to fall to the lower bolt 52 to rest upon said bolt and the next ball to come to rest on the upper bolt 50 awaiting the golfer to repeat the process as previously described.

When the golfer horizontally moves the steel side plate 48 and allows a ball to drop into the lower portion of the base tube 20, the ball comes to rest on the top and back portion of the base plate 24. By a slight tilt forward, the ball then proceeds to roll out through sidewall opening 32 toward the outermost portion of the steel base plate 24, wherein the ball will come to rest in rounded portion 28 and the golfer only has to place this ball on a tee in a downward fashion and then remove the E-Z-T Golf Ball Dispenser from the ball by merely moving the E-Z-T Golf Ball Dispenser in a backward fashion wherein the tee would pass through the slot opening 30 protruding from the rounded portion 28 to the outermost portion of the base plate 24.

The golder then, prior to addressing and hitting the golf ball, merely sets the E-Z-T Golf Ball Dispenser 10 to the side by use of the handle 14 and the E-Z-T Golf Ball Dispenser rests on bypods or tube supports 11 as shown in FIGS. 1 and 3–6. and by base tube 20 as the third portion of the resting device.

FIGS. 2 and 3 depict the forward portion of the steel base plate wherein a ball rests. In a preferred embodiment, this outermost forward portion of the steel base plate has been milled at its front edge and at the edges forming the slot opening so that the metal slants in a knife-like fashion to facilitate the easy pick up of balls that might be on the surface of the practice tee. Once the pick up is achieved, a slight tilting back will roll the ball into the thirteen (13) by sixteenth (16th) inch rounded portion 28 for placement as if the golfer had released a ball through use of the steel foot release 22.

The construction of the E-Z-T Golf Ball Dispenser 10, in the preferred embodiment, can be done in a machine shop utilizing cutting, pressing, and welding of metal. All parts can be made of steel or similar metal composition, but for the vinyl handle 14. All metal parts with the exception of the steel tube 12 can be secured by bolts or rivets and the metal tubes 3 can be attached to each other by welding The use of plastics in the construction of the device is also contemplated which instead of welding would involve the gluing of parts in place of welding.

U.S. Pat. No. 3,533,631-Hladek and U.S. Pat. No. 4,103,295-Baughman, can be differentiated in that both golf ball dispensing devices have different trigger/- release mechanisms. The exact form of the dispensing arrangement as previously set forth in conjunction with golf balls is not found in prior art. To the best of the inventor's information and belief, this invention and device does not constitute an improvement to any existing device or invention and, consequently, description of improvements is not relevant.

I claim:

1. A golf ball dispensing device comprising:

a vertically disposed base tube having a substantially square cross-section, said base tube being open at an upper end and having an opening in a side wall of said base tube at a lower portion;

a flange attached to said upper end of said base tube and extending horizontally therefrom;

a vertical shaft attached to and extending upwardly from said flange;

a ball storage section comprising a plurality of vertical cylindrical tubes rotatably mounted around said vertical shaft, said tubes being disposed such that rotation of said storage section will allow said tubes to sequentially come into substantially vertical alignment with said open upper end of said base tube to permit communication therebetween, and said flange is disposed to substantially cover said tubes at a lower end when said tubes are not in alignment with said open upper end of the base tube;

a handle extending substantially horizontally from an upper end of said shaft;

support means comprising at least two support legs extending downwardly from said flange to cooperate with said base tube to support said device in a substantially vertical position when placed on a horizontal surface;

a dispenser mechanism attached to said base tube, said mechanism comprising a foot release portion having a plate slideably mounted adjacent to an outside wall of said base tube, means for guiding said plate for movement in a substantially horizontal direction between a first and a second position, at least a portion of said plate protruding away from said base tube to provide a surface for engagement of a foot of a user;

means for biasing said plate toward said first position;

a first or upper cylindrical rod projecting perpendicularly from said plate through a first horizontal slot in said adjacent wall of the base tube at a predetermined height, said first rod being disposed such that when said plate is moved away from said first position said first rod will prohibit passage through said base tube of a golf ball to be dispensed and when said plate returns to said first position said first rod will allow passage through said base tube;

a second or lower cylindrical rod projecting substantially perpendicularly from said plate through a second horizontal slot in said adjacent wall of the base tube, said second rod being disposed such that when said plate is in said first position, said second rod will prohibit passage of a golf ball to be dispensed into said lower portion of said base tube, and will allow passage of a golf ball to be dispensed into said lower portion when said plate is in said second position, said second rod being disposed at a predetermined height above the bottom of said base tube, said second rod further being vertically spaced below said first rod at a distance substantially equal to a diameter of a golf ball to be dispensed; and a base plate attached to the bottom of said base tube, said base plate projecting horizontally outwardly from beneath said base tube from the wall containing the vertically disposed opening, said base plate having vertical side walls on said projecting portion, said base plate further having a circular cutout in said projecting portion near an outermost portion thereof, said cutout having a diameter slightly less than a diameter of a golf ball to be dispensed, said base plate further having a slot cutout extending from an outermost edge to said circular cutout, said cutout having edge being spaced apart at a predetermined distance substantially less than a diameter of a golf ball to be dispensed.

2. The device according to claim 1 wherein the edges of said base plate forming the slot cutout taper outwardly toward said vertical sidewalls.

3. The device according to claim 1 wherein said base plate is tapered from a full thickness of the base plate to a knifelike edge at the outermost portions.

4. The device according to claim 3 wherein said base plate is is tapered from a full thickness of the base plate to a knifelike edge at the edges of the slot cutout.

* * * * *

UNITED STATES PATENT AND TRADEMARK OFFICE

CERTIFICATE OF CORRECTION

PATENT NO. : 4,676,397

DATED : June 30, 1987

INVENTOR(S) : Hoffmeister

It is certified that error appears in the above-identified patent and that said Letters Patent is hereby corrected as shown below:

Column 6, line 35, "edge" should be --edges--.
Column 6, line 45, delete "is" second occurence.

Signed and Sealed this

Tenth Day of November, 1987

*Attest:*

DONALD J. QUIGG

*Attesting Officer*

*Commissioner of Patents and Trademarks*